US012357862B2

(12) United States Patent
Su

(10) Patent No.: US 12,357,862 B2
(45) Date of Patent: Jul. 15, 2025

(54) BALANCE BEAM

(71) Applicant: Yinglin Han, Shandong (CN)

(72) Inventor: Qingyong Su, Qingdao (CN)

(73) Assignee: Yinglin Han, Qingdao (CN)

( * ) Notice: Subject to any disclaimer, the term of this patent is extended or adjusted under 35 U.S.C. 154(b) by 77 days.

(21) Appl. No.: 18/297,921

(22) Filed: Apr. 10, 2023

(65) Prior Publication Data

US 2024/0017112 A1 Jan. 18, 2024

(30) Foreign Application Priority Data

Jul. 13, 2022 (CN) ..... 202221812599.5

(51) Int. Cl.
*A63B 4/00* (2006.01)

(52) U.S. Cl.
CPC ..... *A63B 4/00* (2013.01); *A63B 2210/50* (2013.01)

(58) Field of Classification Search
CPC ..... A63B 4/00; A63B 2210/50; A63B 5/06; A63B 5/12
See application file for complete search history.

(56) References Cited

U.S. PATENT DOCUMENTS 3,582,068 A * 6/1971 Hallgren ..... A63B 4/00 482/34
5,037,086 A 8/1991 Strand
5,616,102 A * 4/1997 Lahmann ..... A63B 4/00 434/258
5,885,189 A * 3/1999 Lane ..... A63B 4/00 248/560
6,077,195 A * 6/2000 Lane ..... A63B 4/00 248/560
6,168,549 B1 1/2001 Squibb et al.
6,517,466 B2 2/2003 Eyman, Jr et al.
7,591,763 B1 * 9/2009 Fucci ..... A63B 21/4013 482/52
10,434,370 B2 10/2019 Brieu et al.
11,351,408 B2 6/2022 Landsman et al.
2002/0177508 A1 * 11/2002 Eyman, Jr. ..... A63B 4/00 482/23
2020/0154877 A1 * 5/2020 Hurley ..... A47B 3/083

FOREIGN PATENT DOCUMENTS

CN 206715121 U 12/2017
CN 208552946 U 3/2019
CN 210645054 U 6/2020
DE 202010003449 U1 * 8/2010 ..... A63B 4/00

* cited by examiner

*Primary Examiner* — Nyca T Nguyen
(74) *Attorney, Agent, or Firm* — Metis IP LLC

(57) ABSTRACT

The present disclosure may provide a balance beam. The balance beam may include a beam body and one or more support assemblies configured to support the beam body. The beam body may include one or more chambers. Each of the one or more chambers may be configured to accommodate at least a portion of one of the one or more support assemblies. Each of the one or more support assemblies may be connected with the beam body via a first connection. The support assembly may be configured to rotate, through the first connection, along a first rotation axis for moving into the one or more chambers.

18 Claims, 5 Drawing Sheets

BALANCE BEAM

CROSS-REFERENCE TO RELATED APPLICATIONS

This application claims priority to Chinese Patent Application No. 202221812599.5, filed on Jul. 13, 2022, the contents of which are hereby incorporated by reference.

TECHNICAL FIELD

The present disclosure generally relates to a sports instrument, and more particularly, relates to a balance beam (BB).

BACKGROUND

A balance beam (BB) includes a thin and long beam which is typically raised from the ground through one or more legs at both ends. A user (e.g., a child) performs a series of movements (e.g., leaps, dance poses, handstands, rolls, walkovers, turns) using a balance beam (BB). In order to facilitate the assembly and/or storage of the balance beam, it is desirable to design a balance beam that can be assembled or disassembled in an easy manner. Additionally or alternatively, in order to satisfy practical demands of users, it is desirable to design an adjustment mechanism for easily adjusting a height of the balance beam relative to the ground.

SUMMARY

According to an aspect of the present disclosure, a balance beam may be provided. The balance beam may include a beam body and one or more support assemblies configured to support the beam body. The beam body may include one or more chambers. Each of the one or more chambers may be configured to accommodate at least a portion of one of the one or more support assemblies. Each of the one or more support assemblies may be connected with the beam body via a first connection. The support assembly may be configured to rotate, through the first connection, along a first rotation axis for moving into the one or more chambers.

In some embodiments, a rotation angle of one of the one or more support assemblies may be in a range from 0 degrees to 180 degrees. The rotation angle may be an angle between a surface of the beam body and an axis direction of the at least a portion of one of the one or more support assemblies.

In some embodiments, the rotation angle of the one of the one or more support assemblies may be in a range from 0 degrees to 90 degrees.

In some embodiments, a depth of one of the one or more chambers may exceed a maximum thickness of the at least a portion of one of the one or more support assemblies.

In some embodiments, the one or more chambers may be configured to accommodate the first connection.

In some embodiments, a rotation of the support assembly may adjust a distance between the beam body and the ground.

In some embodiments, the balance beam may further include one or more auxiliary assemblies. Each of the one or more auxiliary assemblies may be connected with the beam body via a second connection, and connected with one of the one or more support assemblies via a third connection. The auxiliary assembly may be configured to rotate, through the second connection, along a second rotation axis. The second rotation axis may be parallel to a minor axis of the beam body.

In some embodiments, the one or more chambers may be configured to accommodate the second connection and the one or more auxiliary assemblies.

In some embodiments, a rotation angle of one of the one or more auxiliary assemblies may be in a range from 0 degrees to 90 degrees. The rotation angle may be an angle between a surface of the beam body and an axis direction of the at least a portion of one of the one or more auxiliary assemblies.

In some embodiments, the third connection between the one of the one or more support assemblies and the one of the one or more support assemblies may be configured to prevent a rotation of the one of the one or more support assemblies after the one of the one or more support assemblies rotates a certain angle.

In some embodiments, the support assembly may include a main body and a base connected with the main body via a fourth connection before the support assembly is accommodated in the one or more chambers.

In some embodiments, the one or more chambers may include a first chamber and a second chamber. The first chamber may be configured to accommodate the main body and the base of one of the one or more supporting assemblies. The second chamber may be configured to accommodate the main body and the base of another one of the one or more supporting assemblies.

In some embodiments, the one or more chambers may include one or more first chambers and one or more second chambers. The one or more first chambers may be configured to accommodate the main body of each of the one or more supporting assemblies. The one or more second chambers may be configured to accommodate the base of each of the one or more supporting assemblies.

In some embodiments, the base may be configured to rotate, through the fourth connection, along a third rotation axis. The third rotation axis may be parallel to a minor axis of the base.

In some embodiments, the base may be accommodated in one of the one or more chambers by detaching the base from the main body via undoing the fourth connection.

In some embodiments, the base may be accommodated in one of the one or more chambers by rotating the base via the fourth connection to extend along a major axis of the beam body.

In some embodiments, the base may be accommodated in one of the one or more chambers by folding the base into two portions that extend along a major axis of the beam body.

In some embodiments, a ratio of a weight of one or more bases of the one or more support assemblies to a weight of the balance beam may exceed 50%.

In some embodiments, the beam body may be made of wood, carbon fiber, or plastic, the main body may be made of aluminum, iron, plastic, or carbon fiber, or the base may be made of iron.

According to another aspect of the present disclosure, a balance beam may be provided. The balance beam may include a beam body, one or more support assemblies, and one or more auxiliary assemblies. The one or more support assemblies may be configured to support the beam body. The one or more auxiliary assemblies may be physically connected with the beam body and the one or more support assemblies. The beam body may include one or more chambers configured to accommodate at least a portion of the one or more support assemblies and the one or more auxiliary assemblies. Each of the one or more support assemblies may include a main body. The main body may be physically connected with the beam body. Each of the one or more auxiliary assemblies may be configured to adjust a height of the beam body.

In some embodiments, the auxiliary assembly may include at least one of a slide groove, at least one clamping slot, or a limiting component. The limiting component may be movably connected with the main body. The at least one clamping slot may be located at a wall of the slide groove. The limiting component and the slide groove may be in a slidable connection. The height of the beam body may be adjusted by clamping the limiting component into one of the at least one clamping slot.

In some embodiments, the auxiliary assembly may further include a bolt connected with the limiting component, and configured to fix the limiting component.

In some embodiments, the auxiliary assembly may further include a clamping rod connected with the limiting component. The clamping rod and the slide groove may be in a slidable connection. The height of the beam body may be adjusted by clamping the clamping rod into the slide slot.

In some embodiments, the main body may fix the beam body through a screw and a threaded hole.

In some embodiments, the one or more chambers may include at least one chamber configured to house one or more main bodies of the one or more support assemblies, respectively. Each of the one or more support assemblies may correspond to one of the at least one chamber. Additionally or alternatively, the one or more chambers may include a chamber configured to house all of the one or more main bodies of the one or more support assemblies.

In some embodiments, each of the one or more support assemblies may further include a base connected with the main body.

In some embodiments, the base and the main body may be in a detachable connection.

In some embodiments, the base and the main body may be in a rotatable connection.

In some embodiments, the one or more chambers may include at least one chamber configured to house one or more bases of the one or more support assemblies, respectively. Each of the one or more bases may correspond to one of the at least one chamber. Additionally or alternatively, the one or more chambers include a chamber configured to house all of the one or more bases of the one or more support assemblies.

In some embodiments, each of the one or more main bodies may be rotatably connected with the beam body.

According to another aspect of the present disclosure, a balance beam may be provided. The balance beam may include a beam body and one or more support assemblies configured to support the beam body. Each of the one or more support assemblies may include a main body connected with the beam body and a base connected with the main body. The base may be foldable into two portions that extend along a major axis of the beam body.

In some embodiments, a width of the beam body may be larger than or equal to a total of widths of the two portions of the base along a minor axis of the beam body.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. The drawings are not to scale. These embodiments are non-limiting exemplary embodiments, in which like reference numerals represent similar structures throughout the several views of the drawings, and wherein.

DETAILED DESCRIPTION

Figure 1:
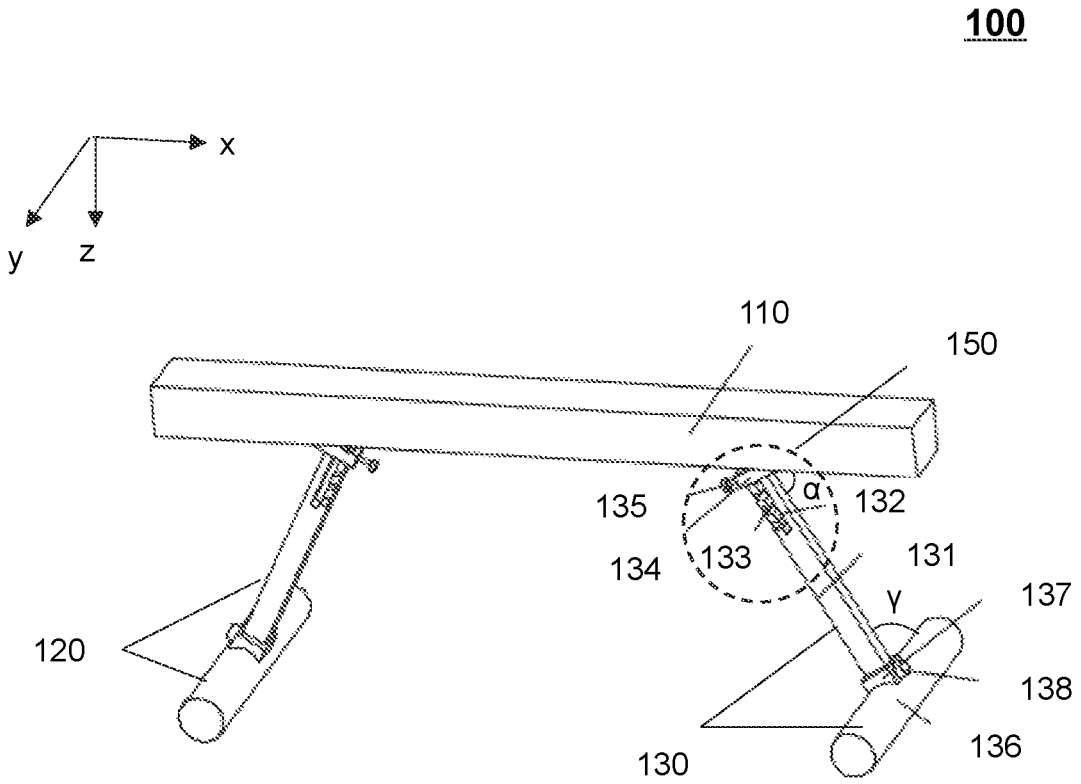
FIG. 1 is a stereogram illustrating an exemplary balance beam according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. In the present disclosure, unless otherwise expressly specified, the terms "mount," "connect," "couple," "fix," "assemble," "disassemble," etc., should be understood in a broad sense, for example, it may be a fixed connection, a detachable connection, integrated into a whole, a mechanical connection, an electrical connection, directly connected, or indirectly connected via an intermediate medium, an internal connection of two elements, or an interconnection of two elements. For those skilled in the art, the specific meanings of the above terms in the present disclosure may be understood according to specific circumstances.

In the present disclosure, spatial reference terms such as "center," "longitudinal," "transverse," "length," "width," "thickness," "upper," "lower," "front," "left," "right," "vertical," "horizontal," "top," "bottom," "inner," "outer," "clockwise," "counterclockwise," "axial," "radial," "circumferential," etc., indicate, in a relative sense, an orientation or positional relationship between two or more elements, assemblies, devices, or systems based on an orientation or positional relationship as shown in the drawings, and are only for the convenience and simplicity of description, rather than indicating or implying that the elements, assemblies, devices, or systems in the present disclosure have a particular orientation when the disclosed system, or a portion thereof, is in operation, or are constructed and operated in a particular orientation, and therefore should not be understood as a limitation of the present disclosure.

In the present disclosure, unless expressly stated otherwise, a first feature being "above" or "below" a second feature may be that the first feature and the second feature are in direct contact, or the first feature and the second feature may be in indirect contact via an intermediate medium. In some embodiments, the first feature being "above" or "on" the second feature may mean that the first feature is directly above or obliquely above the second feature, or simply mean that a horizontal height of the first feature is higher than a horizontal height of the second feature. The first feature being "below" or "underneath" the second feature may mean that the first feature is directly below or obliquely below the second feature, or it may simply mean that a horizontal height of the first feature is smaller than a horizontal height of the second feature.

It will be understood that, although the terms "first," "second," "third," etc., may be used herein to distinguish one element from another. For example, a first element may be termed a second element, and similarly, a second element may be termed a first element, without departing from the scope of exemplary embodiments of the present disclosure.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure. It is understood that the drawings are not to scale.

According to some embodiments of the present disclosure, a balance beam (BB) may be provided. The balance beam may include a beam body and one or more support assemblies. The beam body may be configured to raise from the ground (e.g., the floor where the balance beam is located) through the one or more support assemblies. In some embodiments, each of the one or more support assemblies may include a main body and a base. The main body may be connected with the beam body. The base may touch the ground and be connected with the beam body via the main body.

In some embodiments, the balance beam may be configured to alternate between an assembled configuration and a disassembled configuration. At the assembled configuration, the one or more support assemblies may be configured to support the beam body, such that the beam body raises from the ground stably. A user (e.g., a child) may perform a series of movements (e.g., leaps, dance poses, handstands, rolls, walkovers, turns) via the balance beam. Specifically, the beam body may include a thin and long beam on which the series of movements may be performed.

In some embodiments, at the disassembled configuration, at least a portion (e.g., the main body, the base) of one of the one or more support assemblies may be accommodated in one or more chambers opened in the beam body, thereby reducing the space for storing the beam body while the beam body is not used.

In some embodiments, one of the one or more support assemblies may be accommodated in one of the one or more chambers. In some embodiments, the one or more supporting assemblies may include two support assemblies. The one or more chambers may include a first chamber and a second chamber. The first chamber may be configured to accommodate the main body and the base of one of the one or more supporting assemblies. The second chamber may be configured to accommodate the main body and the base of another one of the one or more supporting assemblies.

In some embodiments, one of the one or more support assemblies may be separately accommodated in different chambers of the one or more chambers. For example, the main body of the support assembly may be accommodated in one chamber, and the base of the support assembly may be accommodated in another chamber. In some embodiments, the one or more chambers may include one or more first chambers and one or more second chambers. The one or more first chambers may be configured to accommodate the main body of each of the one or more supporting assemblies. The one or more second chambers may be configured to accommodate the base of each of the one or more supporting assemblies. In some embodiments, same portions of the one or more support assemblies may be accommodated in a same chamber. For example, the one or more bases of the one or more support assemblies may be accommodated in a same chamber.

In some embodiments, the one or more chambers may be arranged along a major axis (e.g., the x-axis as shown in FIG. 1) of the beam body. A length of the beam body may exceed a total of one or more lengths of the one or more chambers along the major axis of the beam body. A width of each of the one or more chambers may be smaller than a width of the beam body along a minor axis (e.g., the y-axis as shown in FIG. 1) of the beam body. A length of each of the one or more chambers may exceed a length of a corresponding portion of the support assembly that is accommodated in the chamber along the major axis of the beam body. In some embodiments, at least one of the one or more chambers may be separated or communicated with each other.

In some embodiments, the one or more chambers may include one or more grooves sinking inside a back surface of the beam body. "Back surface" used herein may refer to a surface of the beam body facing the ground. In some embodiments, a volume of one of the one or more chambers may exceed a volume of the at least a portion of the support assembly. In some embodiments, a depth (e.g., along the z-axis as shown in FIG. 1) of one of the one or more chambers may exceed a maximum thickness of the at least a portion of the support assembly.

In some embodiment, the one or more support assemblies may be spaced along the major axis of the beam body to support the beam body stably in the assembled configuration. In some embodiments, the one or more support assemblies may include two support assemblies located at opposite sides of the beam body along the major axis of the beam body, that is, there are two main bodies and two bases. In some embodiments, the one or more chambers may include a chamber configured to accommodate one main body, a chamber configured to accommodate another main body, and a chamber configured to accommodate the two bases. A length of the beam body may be larger than a total of a length of the base and lengths of the two main bodies. In some embodiments, the one or more chambers may include a chamber configured to accommodate one main body, a chamber configured to accommodate another main body, a chamber configured to accommodate one base, and a chamber configured to accommodate another base. A length of the beam body may be larger than a total of lengths of the two bases and lengths of the two main bodies.

In some embodiments, after at least a portion of the one or more support assemblies is accommodated in the one or more chambers, the one or more chambers may be covered by one or more covers, respectively. Thus, the at least a portion of the one or more support assemblies may be limited in the one or more chambers. In some embodiments, the one or more covers may be separated or communicated.

In some embodiments, each of the one or more support assemblies may be connected with the beam body via a first connection. A first portion of the support assembly may be connected with the beam body via the first connection. For example, the first portion of the support assembly may include the main body of the support assembly. The first connection may alternate between a flexible configuration and a fixed configuration. At the flexible configuration, the first portion of the support assembly may be configured to rotate, through the first connection for moving into or out of the one or more chambers, that is, the balance beam is at the disassembled configuration. At the fixed configuration, the first portion of the support assembly may be configured to fix on the beam body via the first connection, that is the balance beam is at the assembled configuration. In some embodiments, the first portion of the support assembly may rotate in a clockwise direction or in a counterclockwise direction. In some embodiments, the first portion of the support assembly may rotate along a first rotation axis. In some embodiments, the first rotation axis may be (substantially) parallel to the minor axis of the beam body. "Substantially" used herein may indicate that a deviation between the first rotation axis and the minor axis is below a threshold, e.g., 10%, 8%, 5%, etc.

In some embodiments, at the flexible configuration, a rotation angle of the first portion of the support assembly may be in a range from 0 degrees to 180 degrees. In some embodiments, at the flexible configuration, the rotation angle of the first portion of the support assembly may be in a range from 0 degrees to 90 degrees, 0 degrees to 80 degrees, 0 degrees to 70 degrees, 0 degrees to 60 degrees, 0 degrees to 50 degrees, 0 degrees to 40 degrees, 0 degrees to 30 degrees, 0 degrees to 20 degrees, etc. As used herein, the rotation angle may refer to an included angle between a surface (e.g., the back surface) (e.g., the xy plane shown in FIG. 1) of the beam body (or the major axis of the beam body) and an axis direction of the first portion of the support assembly (e.g., a major axis of the first portion of the support assembly). In some embodiments, at the fixed configuration, an included angle (e.g., angle $\alpha$ in FIG. 1) between the surface of the beam body (or the major axis of the beam body) and the axis direction of the first portion of the support assembly may be smaller than a preset degree (e.g., 15 degrees, 30 degrees, 45 degrees, 60 degrees, 75 degrees, 90 degrees).

In some embodiments, the first connection may be implemented via mechanically flexible coupling, metallic element coupling, elastomeric element coupling, etc. For example, the first connection may include a hinged connection. In some embodiments, the one or more chambers may be configured to accommodate the first connection. The first connection may be accommodated in a same chamber as the first portion of the support assembly.

In some embodiments, the balance beam may include one or more auxiliary assemblies. The one or more auxiliary assemblies may be configured to facilitate the configuration alteration (i.e., the flexible configuration, the fixed configuration) of the first connection. When one of the one or more auxiliary assemblies is flexibly connected with the beam body and/or a corresponding first portion of the support assembly, the first connection may be at the flexible configuration; when the auxiliary assembly is fixedly connected with the beam body and/or the corresponding first portion of the support assembly, the first connection may be at the fixed configuration.

In some embodiments, a rotation of the support assembly may adjust a distance (e.g., along the z-axis in FIG. 1) between the beam body and the ground, that is, adjust a height of the beam body with respect to the ground. In some embodiments, each of the one or more auxiliary assemblies may be connected with the beam body via a second connection, and connected with one of the one or more support assemblies via a third connection.

In some embodiments, the second connection may alternate between a flexible configuration and a fixed configuration. At the flexible configuration, the auxiliary assembly may be configured to rotate, through the second connection, along a second rotation axis, thereby adjusting the distance between the beam body and the ground, that is, the balance beam is at the disassembled configuration. At the fixed configuration, the auxiliary assembly may be configured to fix on the beam body via the second connection, that is the balance beam is at the assembled configuration. In some embodiments, the second rotation axis may be (substantially) parallel to the minor axis of the beam body. "Substantially" used herein may indicate that a deviation between the second rotation axis and the minor axis is below a threshold, e.g., 10%, 8%, 5%, etc.

Figure 2:
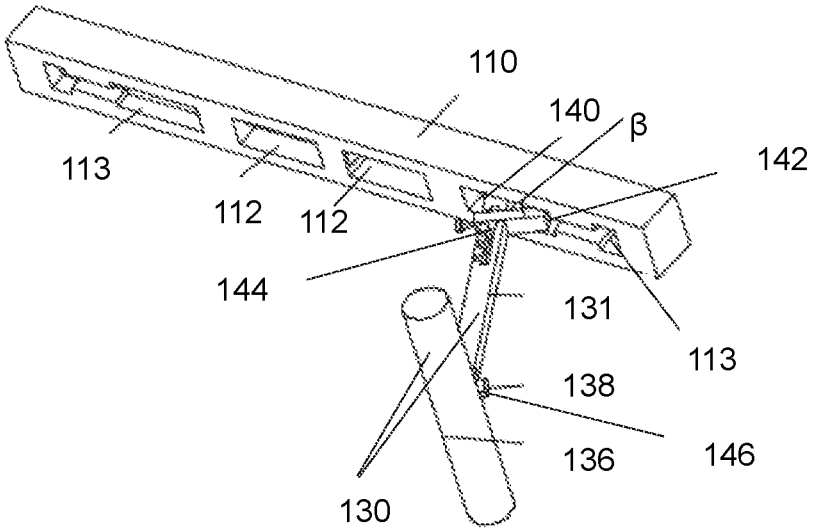
FIG. 2 is a stereogram illustrating a portion of an exemplary balance beam according to some embodiments of the present disclosure.

In some embodiments, at the flexible configuration, a rotation angle of the auxiliary assembly may be in a range from 0 degrees to 180 degrees, 0 degrees to 150 degrees, 0 degrees to 120 degrees, 0 degrees to 90 degrees, 0 degrees to 60 degrees, 0 degrees to 30 degrees, etc. As used herein, the rotation angle may be an angle between a surface (e.g., the back surface) (e.g., the xy plane shown in FIG. 1) (or the major axis of the beam body) of the beam body and an axis direction of the at least a portion of one of the one or more auxiliary assemblies (e.g., a major axis of the at least a portion of the auxiliary assembly). At the fixed configuration, an included angle between an axis direction of the auxiliary assembly (e.g., a major axis of the auxiliary assembly) and the surface of the beam body (e.g., the xy plane as shown in FIG. 1) (or the major axis of the beam body) may be fixed (e.g., angle $\beta$ as shown in FIG. 2) (e.g., 10 degrees, 25 degrees, 30 degrees, 45 degrees, 60 degrees, 75 degrees).

In some embodiments, the third connection may alternate between a flexible configuration and a fixed configuration. At the flexible configuration, the auxiliary assembly may be configured to slide, through the second connection, along an axis direction of the first portion of the support assembly (e.g., a major axis of the first portion of the support assembly), thereby adjusting the distance between the beam body and the ground, that is, the balance beam is at the disassembled configuration. At the fixed configuration, the auxiliary assembly may be configured to fix on the first portion of the support assembly via the third connection, that is, the balance beam is at the assembled configuration.

In some embodiments, the third connection between the one of the one or more support assemblies and the one of the one or more support assemblies may be configured to prevent a rotation of the one of the one or more support assemblies after the one of the one or more support assemblies rotates a certain angle. Thus, in the assembled configuration, the balance beam may stand stably.

In some embodiments, the one or more chambers may be configured to accommodate the second connection, the third connection, and the one or more auxiliary assemblies. In some embodiments, the second connection, the third connection, and the auxiliary assembly may be accommodated in a same chamber as the first portion of the support assembly.

In some embodiments, the auxiliary assembly may include at least one of a slide groove, at least one clamping slot, or a limiting component (e.g., a limiting ring). The limiting component may be movably connected with the main body. The limiting component and the slide groove may be in a slidable connection. The height of the beam body may be adjusted by clamping the limiting component into one of the at least one clamping slot. In some embodiments, the main body may include a hollow structure, forming the slide groove. The at least one clamping slot may be located at a wall of the slide groove.

In some embodiments, the auxiliary assembly may also include a bolt connected with the limiting component, and configured to fix the limiting component. In some embodiments, by unfastening the bolt, the auxiliary assembly may be flexibly connected with the limiting component, that is, the auxiliary assembly may be flexibly connected with the main body.

In some embodiments, the auxiliary assembly may also include a clamping rod connected with the limiting component. The clamping rod and the slide groove may be in a slidable connection. The height of the beam body may be adjusted by clamping the clamping rod into the slide slot.

In some embodiments, the main body fixes the beam body through a screw and a threaded hole.

In some embodiments, the base of the support assembly may be connected with the main body of the support assembly via a fourth connection before the support assembly is accommodated in the one or more chambers (that is, the balance beam is in the assembled configuration). In some embodiments, the base may be configured to rotate, through the fourth connection, along a third rotation axis. In some embodiments, the third rotation axis may be (substantially) parallel to a minor axis of the base. In some embodiments, the main body may include a first rod. The base may include a second rod connected with the first rod.

In some embodiments, at the fixed configuration, an included angle between an axis direction of the base (e.g., a major axis of the base) and an axis direction of the main body (e.g., a major axis of the main body) may be fixed (e.g., angle $\gamma$ as shown in FIG. 1) (e.g., 45 degrees, 50 degrees, 60 degrees, 70 degrees, 80 degrees). In some embodiments, the base may be accommodated in one of the one or more chambers by rotating the base via the fourth connection to extend along the major axis of the beam body. The main body may be accommodated in one of the one or more chambers by rotating the main body via the first connection to extend along the major axis of the beam body. In some embodiments, the base may be rotated to extend along the major axis of the main body via the fourth connection, then be accommodated into a chamber together with the main body by rotating the main body to extend along the major axis of the beam body via the first connection. In such cases, the base may first be rotated to extend along the major axis of the main body and then to extend along the major axis of the beam body.

In some embodiments, the base may be accommodated in one of the one or more chambers by detaching the base from the main body via undoing the fourth connection. The base may be fastened on the main body by rotating the base in a first direction. The base may be detached from the main body by rotating the base in a second direction. The second direction may be opposite from the first direction.

In some embodiments, the base may be foldable into two portions. The base may include two folding components configured to fold the base into the two portions. In some embodiments, the two portions may be folded inward (i.e., towards the main body) (e.g., along a direction indicated by arrow a in FIG. 4) via the two folding components. In some embodiments, the two portions may be folded outward via the two folding portions. The base may be accommodated in one of the one or more chambers by folding the base into two portions that extend along the major axis of the beam body. In such cases, the balance beam may be at the disassembled configuration. In some embodiments, at the assembled configuration, the two folding components may be covered by two covers (e.g., two rotatable rings) to avoid the folding of the base, such that the balance beam may stand stably. By moving the two covers to other positions of the base other than covering the two folding components, the base can be folded via the two folding components.

In some embodiments, in order to make the balance beam stand stable, a ratio of a weight of one or more bases of the one or more support assemblies to a weight of the balance beam may exceed 50%, 60%, 70%, 80%, etc. In some embodiments, at least one of the beam body, the main body, or the base may be made of the same material or different materials. In some embodiments, the beam body may be made of wood, carbon fiber, plastic, or a combination thereof. The main body may be made of aluminum, iron, plastic, carbon fiber, or the like, or any combination thereof. The base may be made of iron. In some embodiments, the beam body may be wrapped by a cover. The cover may be made of cloth.

In some embodiments, in order to make the balance beam stand stable, a ratio of a length of the beam body along the major axis of the beam body to a length of the main body along the major axis of the beam body may range from 5.5 to 6, 5 to 6.5, 4.5 to 7, 4 to 7.5, 3.5 to 8, etc. A ratio of a length of the beam body along the major axis of the beam body to a length of the base along the major axis of the base may range from 5 to 5.5, 4.5 to 6, 4 to 6.5, 3.5 to 7, 3 to 7.5, etc. A ratio of the length of the main body along the major axis of the main body to the length of the base along the major axis of the base may range from 0.9 to 1, 0.8 to 1.1, 0.7 to 1.2, 0.6 to 1.3, 0.5 to 1.4, etc.

In some embodiments, in order to make the balance beam stand stable, a ratio of a length of the beam body along the minor axis of the beam body to a length of the main body along a minor axis of the main body may range from 3 to 3.5, 2.5 to 4, 2 to 4.5, 1.5 to 5, etc. A ratio of a length of the beam body along the minor axis of the beam body to a length of the base along a minor axis of the base may range from 2 to 2.5, 1.8 to 3, 1.6 to 3.5, 1.4 to 4, 1.2 to 5, etc. A ratio of the length of the main body along the minor axis of the main body to the length of the base along the minor axis of the base may range from 0.5 to 1, 0.4 to 1.2, 0.3 to 1.4, 0.1 to 1.6, etc.

According to some embodiments of the present disclosure, a balance beam may be provided. The balance beam may include a beam body, one or more support assemblies, and one or more auxiliary assemblies. The one or more support assemblies may be physically connected with the beam body and configured to support the beam body. The one or more auxiliary assemblies may be physically connected with the beam body and the one or more support assemblies. The beam body may include one or more chambers configured to accommodate at least a portion of the one or more support assemblies and the one or more auxiliary assemblies. Each of the one or more support assemblies may include a main body being physically connected with the beam body. Each of the one or more auxiliary assemblies may be configured to adjust a height of the beam body.

According to some embodiments of the present disclosure, a balance beam may be provided. The balance beam may include a beam body and one or more support assemblies. The one or more support assemblies may be configured to support the beam body. Each of the one or more support assemblies may include a main body connected with the beam body and a base connected with the main body. The beam body may be configured to raise from the ground (e.g., the floor where the balance beam is located) through the one or more support assemblies. The main body may be connected with the beam body. The base may touch the ground and be connected with the beam body via the main body.

In some embodiments, the base may be foldable into two portions. The base may include two folding components configured to fold the base into the two portions. The two portions may be folded to extend along a major axis (e.g., the x-axis as shown in FIG. 1) of the beam body. In some embodiments, the two portions may be folded inward (i.e., towards the main body) (e.g., along a direction indicated by arrow a in FIG. 4) via the two folding components. In some embodiments, the two portions may be folded outward via the two folding portions. In some embodiments, a width of the beam body may be larger than or equal to a total of widths of the two portions of the base along a minor axis (e.g., the y-axis as shown in FIG. 1) of the beam body. In some embodiments, the base may first fold into the two portions that extend along the major axis of the beam body and then be placed at a back surface (a surface towards the ground) of the beam body. In such cases, the balance beam may be at a disassembled configuration. In some embodiments, at the assembled configuration, the two folding components may be covered by two covers (e.g., two rotatable rings) to avoid the folding of the base, such that the balance beam may stand stably. By moving the two covers to other positions of the base other than covering the two folding components, the base may be folded via the two folding components.

In some embodiments, the main body may be fixedly connected to the beam body by welding, screwing, embedding, a mechanical element, etc. For example, the mechanical element may include a bolt, a screw, a nut, a converter, an adaptor ring, a gasket, an airtight glue, an airtight adhesive tape, or the like, or any combination thereof.

Figure 3:
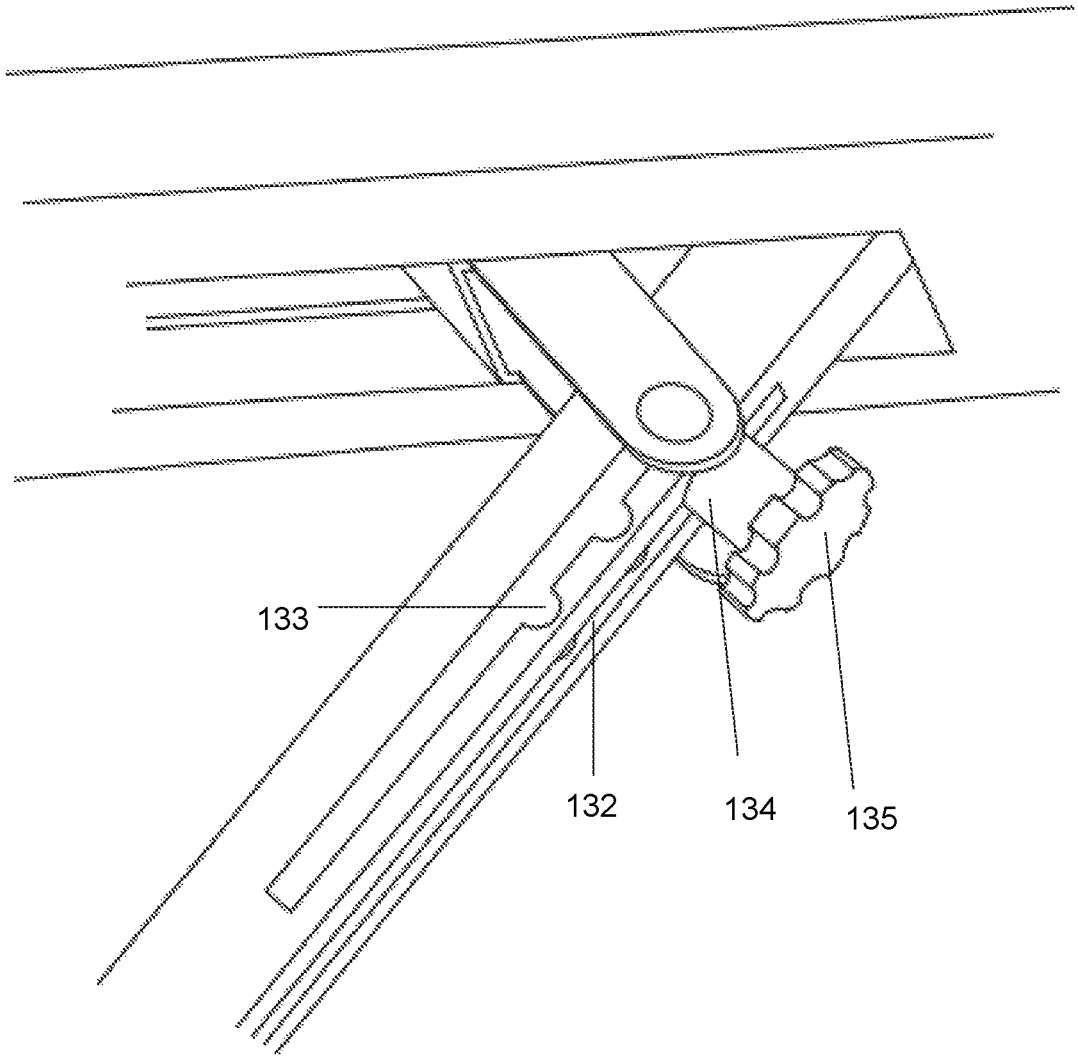
FIG. 3 is a stereogram illustrating an exemplary auxiliary assembly according to some embodiments of the present disclosure.

FIG. 1 is a stereogram illustrating an exemplary balance beam according to some embodiments of the present disclosure. FIG. 2 is a stereogram illustrating a portion of an exemplary balance beam according to some embodiments of the present disclosure. FIG. 3 is a stereogram illustrating an exemplary auxiliary assembly according to some embodiments of the present disclosure.

As shown in FIG. 1 and FIG. 2, the balance beam 100 may include a beam body 110, a support assembly 120, and a support assembly 130. In some embodiments, the support assembly 120 may be the same as or similar to the support assembly 130 except that the support assembly 120 and the support assembly 130 are located at different positions. As shown in FIG. 1, the support assembly 120 and the support assembly 130 may be located at two opposite sides of the beam body 110 along a major axis (e.g., the x-axis) of the beam body 110.

The beam body 110 may raise from the ground through the support assemblies 120 and 130. In some embodiments, the balance beam 100 may be configured to alternate between an assembled configuration and a disassembled configuration. At the assembled configuration, the support assemblies 120 and 130 may support the beam body 110, such that the beam body 110 raises from the ground stably. At the disassembled configuration, the support assemblies 120 and 130 may be accommodated in chambers 112 and 113 opened in the beam body 110.

The support assembly 120 or 130 may include a main body 131 and a base 136. The main body 131 may be connected with the beam body 110 via a first connection 140. The main body 131 may be rotated for moving into or out of the chamber 113 through the first connection 140. The base 136 may touch the ground and be connected with the main body 131 via a fourth connection 146. The base 136 may be detached from the main body 131 via undoing the fourth connection 146. Then the base 136 may be accommodated in the chamber 112.

In some embodiments, a rotation of the support assembly 120 or 130 may adjust a distance (e.g., along the z-axis) between the beam body 110 and the ground. In some embodiments, the rotation of the support assembly 130 may be achieved via an auxiliary assembly 150. The auxiliary assembly 150 may be connected with the beam body 110 via a second connection 142, and connected with the support assembly 130 via a third connection 144.

In some embodiments, the second connection 142 may alternate between a flexible configuration and a fixed configuration. At the flexible configuration, the auxiliary assembly 150 may be configured to rotate, through the second connection 142, thereby adjusting the distance between the beam body 110 and the ground, that is, the balance beam 100 is at the disassembled configuration. At the fixed configuration, the auxiliary assembly 150 may be configured to fix on the beam body 110 via the second connection 142, that is the balance beam 100 is at the assembled configuration.

In some embodiments, the third connection 144 may alternate between a flexible configuration and a fixed configuration. At the flexible configuration, the auxiliary assembly 150 may be configured to slide, through the third connection 144, along an axis direction of the main body 131 (e.g., a major axis of the main body 131), thereby adjusting the distance between the beam body 110 and the ground, that is, the balance beam is at the disassembled configuration. At the fixed configuration, the auxiliary assembly 150 may be configured to fix on the main body 131 via the third connection 144, that is, the balance beam 100 is at the assembled configuration.

As shown in FIGS. 1-3, the auxiliary assembly 150 may include a slide groove 132, at least one clamping slot 133, and a limiting component 134 (e.g., a limiting ring). The limiting component 134 may be movably connected with the main body 131. The at least one clamping slot 133 may be located at a wall of the slide groove 132. The limiting component 134 and the slide groove 132 may be in a slidable connection. The distance between the beam body 110 and the ground may be adjusted by clamping the limiting component 134 into one of the at least one clamping slot 133. The auxiliary assembly 150 may also include a bolt 135 connected with the limiting component 134, and configured to fix the limiting component 134. The base 136 may be connected with the main body 131 via a screw 138 and a threaded hole 137.

Figure 4:
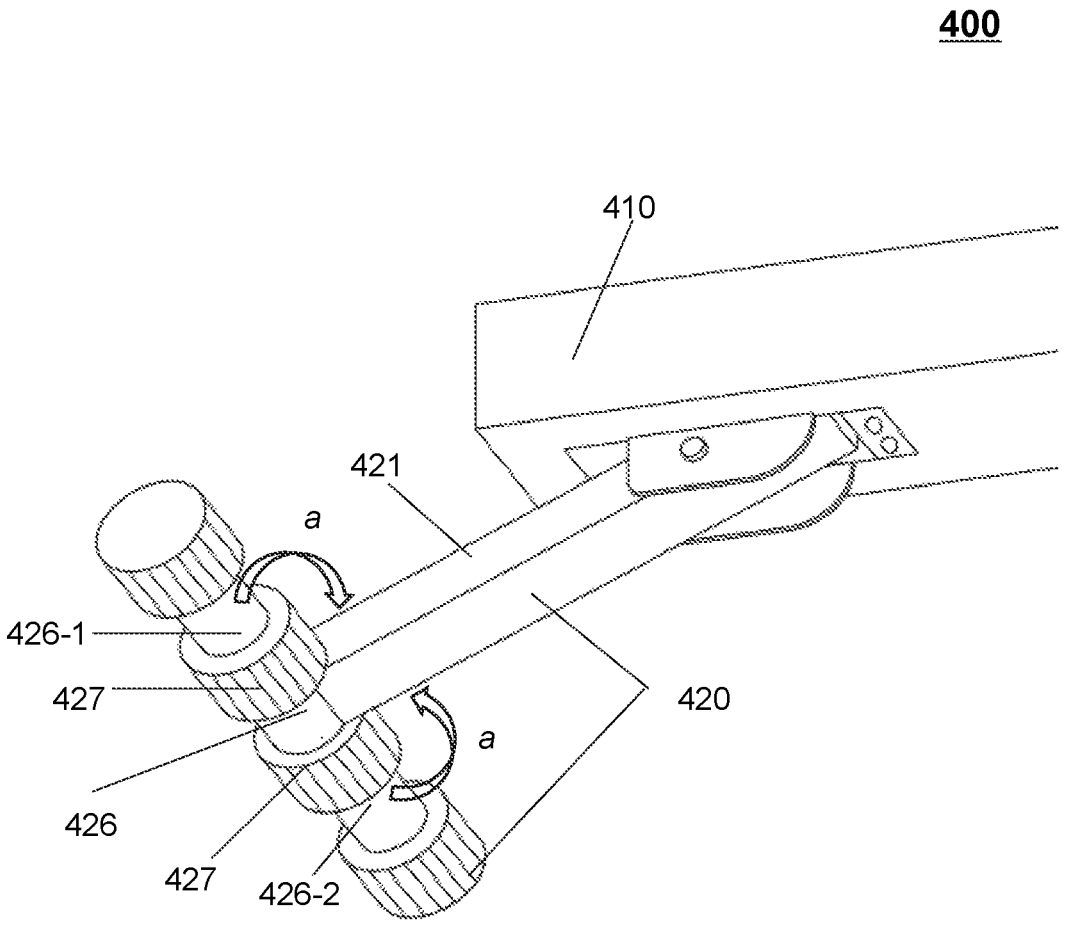
FIG. 4 is a stereogram illustrating a portion of an exemplary balance beam in an assembled configuration according to some embodiments of the present disclosure.
Figure 5:
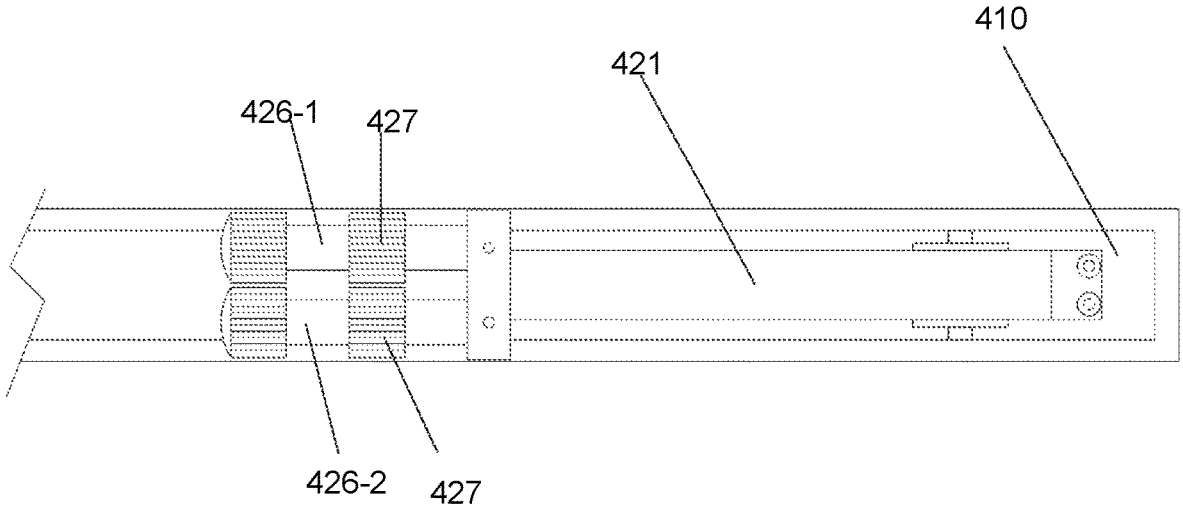
FIG. 5 is a stereogram illustrating a portion of an exemplary balance beam in a disassembled configuration according to some embodiments of the present disclosure.

FIG. 4 is a stereogram illustrating a portion of an exemplary balance beam in an assembled configuration according to some embodiments of the present disclosure. FIG. 5 is a stereogram illustrating a portion of an exemplary balance beam in a disassembled configuration according to some embodiments of the present disclosure.

As shown in FIG. 4 and FIG. 5, the balance beam 400 may include a beam body 410 and a support assembly 420. The beam body 410 may raise from the ground at least through the support assembly 420. In some embodiments, the balance beam 400 may be configured to alternate between an assembled configuration and a disassembled configuration. At the assembled configuration, the support assembly 420 may support the beam body 410, such that the beam body 410 raises from the ground stably.

The support assembly 420 may include a main body 421 and a base 426. The main body 421 may be connected with the beam body 410. The base 426 may touch the ground and be connected with the main body 421. At the disassembled configuration, the base 426 may be folded into two portions 426-1 and 426-2 that extend along a major axis (e.g., the x-axis as shown in FIG. 1) of the beam body 421 and placed at a back surface (a surface towards the ground) of the beam body 410.

At the assembled configuration, the main body 421 may be fixedly connected with the beam body 410 via a bolt and a threaded hole. At the disassembled configuration, the fixed connection between the main body 421 and the beam body 410 may be undone. The main body 421 may be rotated to extend along the major axis of the beam body 410 placed at the back surface of the beam body 410.

In some embodiments, the base 426 may include two folding components configured to fold the base 426 into the two portions 426-1 and 426-2. At the assembled configuration shown in FIG. 4, the two folding components may be covered by two covers 427 (e.g., two rotatable rings) to avoid the folding of the base 426, such that the balance beam 400 may stand stably. By moving the two covers 427 to other positions of the base 426 other than covering the two folding components, the base 426 can be folded via the two folding components.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer readable media having computer readable program code embodied thereon.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed object matter requires more features than are expressly recited in each claim. Rather, inventive embodiments lie in less than all features of a single foregoing disclosed embodiment.

In some embodiments, the numbers expressing quantities or properties used to describe and claim certain embodiments of the application are to be understood as being modified in some instances by the term "about," "approximate," or "substantially." For example, "about," "approximate," or "substantially" may indicate ±1%, ±5%, ±10%, or ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A balance beam, comprising:

a beam body including one or more chambers;

one or more support assemblies configured to support the beam body, wherein each of the one or more chambers is configured to accommodate at least a portion of one of the one or more support assemblies, each of the one or more support assemblies is connected with the beam body via a first connection, and the support assembly is configured to rotate, through the first connection, along a first rotation axis for moving into the one or more chambers; and one or more auxiliary assemblies, each of the one or more auxiliary assemblies is connected with the beam body via a second connection, and connected with one of the one or more support assemblies via a third connection, the auxiliary assembly is configured to rotate, through the second connection, along a second rotation axis, the second rotation axis being parallel to a minor axis of the beam body.

2. The balance beam of claim 1, wherein the support assembly includes a main body and a base connected with the main body via a fourth connection before the support assembly is accommodated in the one or more chambers.

3. The balance beam of claim 2, wherein the one or more chambers include a first chamber and a second chamber, the first chamber is configured to accommodate the main body and the base of the one of the one or more support assemblies, and the second chamber is configured to accommodate the main body and the base of another one of the one or more support assemblies.

4. The balance beam of claim 2, wherein the base is configured to rotate, through the fourth connection, along a third rotation axis, the third rotation axis being parallel to a minor axis of the base.

5. The balance beam of claim 4, wherein the base is accommodated in one of the one or more chambers by detaching the base from the main body via undoing the fourth connection.

6. The balance beam of claim 4, wherein the base is accommodated in one of the one or more chambers by rotating the base via the fourth connection to extend along a major axis of the beam body.

7. The balance beam of claim 2, wherein the one or more chambers includes one or more first chambers and one or more second chambers, the one or more first chambers are configured to accommodate the main body of the each of the one or more support assemblies, and the one or more second chambers are configured to accommodate the base of the each of the one or more support assemblies.

8. The balance beam of claim 2, wherein the base is accommodated in one of the one or more chambers by folding the base into two portions that extend along a major axis of the beam body.

9. The balance beam of claim 2, wherein a ratio of a weight of one or more bases of the one or more support assemblies to a weight of the balance beam exceeds 50%.

10. The balance beam of claim 2, wherein the beam body is made of wood, carbon fiber, or plastic, the main body is made of aluminum, iron, plastic, or carbon fiber, or the base is made of iron.

11. The balance beam of claim 1, wherein a rotation angle of the one of the one or more support assemblies is in a range from 0 degrees to 180 degrees, the rotation angle being an angle between a surface of the beam body and an axis direction of the at least a portion of one of the one or more support assemblies.

12. The balance beam of claim 1, wherein a rotation of the support assembly adjusts a distance between the beam body and the ground.

13. The balance beam of claim 1, wherein a rotation angle of one of the one or more auxiliary assemblies is in a range from 0 degrees to 90 degrees, the rotation angle being an angle between a surface of the beam body and an axis direction of the at least a portion of one of the one or more auxiliary assemblies.

14. The balance beam of claim 1, wherein the third connection between the one of the one or more support assemblies and the one of the one or more auxiliary supports is configured to prevent a rotation of the one of the one or more support assemblies after the one of the one or more support assemblies rotates a certain angle.

15. A balance beam, comprising:

a beam body;

one or more support assemblies configured to support the beam body; and one or more auxiliary assemblies, each of the one or more auxiliary assemblies is connected with the beam body via a second connection, and connected with one of the one or more support assemblies via a third connection, the auxiliary assembly is configured to rotate, through the second connection, along a second rotation axis, the second rotation axis being parallel to a minor axis of the beam body, wherein the beam body comprises one or more chambers to accommodate the one or more support assemblies; and wherein each of the one or more support assemblies includes a main body, the main body being physically connected with the beam body, and each of the one or more auxiliary assemblies is configured to adjust a height of the beam body; wherein the auxiliary assembly includes a slide groove, at least one clamping slot, and a limiting component;

the limiting component is movably connected with the main body;

the at least one clamping slot is located at a wall of the slide groove;

the limiting component and the slide groove are in a slidable connection; and the height of the beam body is adjusted by clamping the limiting component into one of the at least one clamping slot.

16. The balance beam of claim 15, wherein the auxiliary assembly further includes a bolt connected with the limiting component, and configured to fix the limiting component.

17. The balance beam of claim 15, wherein the auxiliary assembly further includes a clamping rod connected with the limiting component;

the clamping rod and the slide groove are in a slidable connection; and the height of the beam body is adjusted by clamping the clamping rod into the slide slot.

18. A balance beam, comprising:

a beam body; and one or more support assemblies configured to support the beam body, wherein each of the one or more support assemblies includes a main body connected with the beam body and a base connected with the main body, the beam body includes one or more chambers configured to accommodate at least a portion of the one or more support assemblies, wherein the base is accommodated in one of the one or more chambers by detaching the base from the main body via undoing a connection; or by folding the base into two portions that extend along a major axis of the beam body.

* * * * *